US007724122B2

(12) United States Patent
Leach

(10) Patent No.: US 7,724,122 B2
(45) Date of Patent: May 25, 2010

(54) FUSE PROVIDING CIRCUIT ISOLATION AND VISUAL INTERRUPTION INDICATION

(75) Inventor: John G. Leach, Hickory, NC (US)

(73) Assignee: Thomas & Betts International, Inc., Willmington, DE (US)

( * ) Notice: Subject to any disclaimer, the term of this patent is extended or adjusted under 35 U.S.C. 154(b) by 423 days.

(21) Appl. No.: 11/712,177

(22) Filed: Feb. 28, 2007

(65) Prior Publication Data

US 2008/0117015 A1 May 22, 2008

Related U.S. Application Data

(60) Provisional application No. 60/860,613, filed on Nov. 22, 2006.

(51) Int. Cl.

| | |
|---|---|
| ***H01H 85/04*** | (2006.01) |
| ***H01H 71/18*** | (2006.01) |
| ***H01H 37/74*** | (2006.01) |
| ***H01H 85/30*** | (2006.01) |
| ***H01H 37/76*** | (2006.01) |

(52) U.S. Cl. ..... 337/244; 337/408; 337/164; 337/206; 337/123; 337/388

(58) Field of Classification Search ..... 337/238, 337/164, 206, 408, 123, 244, 388; 29/623
See application file for complete search history.

(56) References Cited

U.S. PATENT DOCUMENTS

| | | | | | |
|---|---|---|---|---|---|
| 2,342,310 | A | * | 2/1944 | Taylor | 337/165 |
| 2,400,491 | A | * | 5/1946 | Duerkob | 337/164 |
| 2,421,658 | A | * | 6/1947 | Strang et al. | 337/244 |
| 2,543,245 | A | | 2/1951 | Laing | |
| 2,613,297 | A | * | 10/1952 | Laing | 337/164 |
| 2,688,677 | A | * | 9/1954 | Laing | 337/164 |
| 2,787,684 | A | * | 4/1957 | Laing | 337/164 |
| 2,913,555 | A | * | 11/1959 | Mcalister | 337/164 |
| 2,953,663 | A | * | 9/1960 | Della et al. | 337/62 |
| 3,144,534 | A | * | 8/1964 | Baumbach | 337/164 |
| 3,182,153 | A | | 5/1965 | Postal | |
| 3,183,327 | A | * | 5/1965 | Kozacka | 337/219 |
| 3,253,104 | A | * | 5/1966 | Fister | 337/232 |

(Continued)

FOREIGN PATENT DOCUMENTS

| | | | |
|---|---|---|---|
| GB | 2126808 | A * | 3/1984 |

*Primary Examiner*—Jayprakash N Gandhi
*Assistant Examiner*—Bradley H Thomas
(74) *Attorney, Agent, or Firm*—Hoffmann & Baron, LLP

(57) ABSTRACT

A fuse including a fuse housing having first and second electrical terminals, a movable partition made from an electrically conductive material movably disposed within the fuse housing, a fusible structure connected between the first electrical terminal and the movable partition, a conductor connected between the movable partition and the second electrical terminal, a biasing element acting on the movable partition to maintain the fusible structure in tension and for moving the movable partition upon melting of the fusible structure and an indicator connected between the movable partition and the second electrical terminal. The conductor, the movable partition and the fusible structure define an electrical path between the first and second electrical terminals and the indicator protrudes out of the second electrical terminal of the fuse housing upon melting of the fusible structure for providing visual indication of an interrupted condition of the fuse when subjected to a threshold current flowing therethrough.

11 Claims, 3 Drawing Sheets

U.S. PATENT DOCUMENTS 3,281,557 A * 10/1966 Fister ..... 337/244
3,593,249 A * 7/1971 Sedgwick ..... 337/113
3,678,430 A * 7/1972 Gaia ..... 337/159
3,710,295 A * 1/1973 Staub et al. ..... 337/166
3,889,222 A * 6/1975 Takano et al. ..... 337/244
3,895,338 A * 7/1975 Gray et al. ..... 337/244
4,025,888 A 5/1977 Judd et al.
4,032,877 A * 6/1977 McAlister ..... 337/148
4,058,784 A * 11/1977 Gaia ..... 337/164
4,153,893 A * 5/1979 Swanson ..... 337/201
4,156,225 A * 5/1979 Cuzzone ..... 337/244
4,189,697 A * 2/1980 Hara ..... 337/407
4,204,182 A * 5/1980 Knapp, Jr. ..... 337/244
4,210,893 A * 7/1980 Hara ..... 337/407
4,220,942 A * 9/1980 Meister et al. ..... 337/277
4,281,309 A * 7/1981 Olson ..... 337/409
4,286,248 A * 8/1981 Hara ..... 337/403
4,344,058 A * 8/1982 Knapp et al. ..... 337/148
4,443,780 A 4/1984 Huai-Chieh
4,492,945 A 1/1985 Jou et al.
4,506,249 A 3/1985 Huber et al.
4,511,876 A * 4/1985 Urani ..... 337/244
4,533,895 A * 8/1985 Kowalik et al. ..... 337/165
4,593,262 A * 6/1986 Krueger ..... 337/163
4,727,347 A * 2/1988 Cambio et al. ..... 337/165
4,888,573 A * 12/1989 Dunn ..... 337/164
4,952,900 A * 8/1990 Cameron et al. ..... 337/217
4,992,770 A * 2/1991 Spalding et al. ..... 337/164
5,043,689 A * 8/1991 Di Troia et al. ..... 337/165
5,109,211 A * 4/1992 Huber ..... 337/158
5,239,291 A * 8/1993 Henricks et al. ..... 337/164
5,254,967 A * 10/1993 Biasutti et al. ..... 337/165
5,604,474 A * 2/1997 Leach et al. ..... 337/158
5,612,663 A * 3/1997 Hollweck ..... 337/407
5,659,283 A 8/1997 Arratia
5,739,737 A 4/1998 Hatton
5,886,613 A * 3/1999 Magoon et al. ..... 337/244
5,920,251 A * 7/1999 Shea ..... 337/140
RE36,317 E 9/1999 Arratia
6,256,183 B1 * 7/2001 Mosesian ..... 361/104
6,456,203 B1 9/2002 Schomaker et al.
6,617,974 B2 9/2003 Stanek
6,642,833 B2 * 11/2003 Ranjan et al. ..... 337/231
6,771,079 B2 8/2004 Lin
6,859,131 B2 2/2005 Stanek et al.
6,873,510 B2 3/2005 Schomaker et al.
6,998,954 B2 2/2006 Milanczak

* cited by examiner

FUSE PROVIDING CIRCUIT ISOLATION AND VISUAL INTERRUPTION INDICATION

CROSS-REFERENCE TO RELATED APPLICATIONS

This application claims the benefit of U.S. Provisional Application No. 60/860,613, filed on Nov. 22, 2006.

FIELD OF THE INVENTION

The present invention relates generally to electric current interruption devices and, more particularly, to a low voltage fuse having the ability to provide circuit isolation and indication of operation in circuits presenting little or no voltage across the open fuse.

BACKGROUND OF THE INVENTION

A fuse is a protective device for electrical circuits which has a fusible element that melts and opens to interrupt the circuit when subjected to excessive currents. The melting occurs, in large part, due to $I^2R$ heating of the fusible element. For many types of fuses, melting at relatively high currents (i.e., currents that produce melting in less than about 1 second) typically occurs at one or more reduced cross-sectional areas of the fusible element, so designed as to control the melting time versus current characteristic of the fuse (melting time-current characteristic or TCC). The TCC is an important characteristic of the fuse that enables it to provide appropriate system protection and coordination with other devices. Favorable ratios of rated continuous current to short time melting current frequently require the use of relatively high melting point materials for the fusible element, such as silver and copper. At longer melting times, a common practice is to employ an additional means to initiate melting and arcing, using a lower melting point material. This is done in order to prevent excessive fuse component temperatures before circuit interruption, and to provide suitable graphical curves of TCC for typical applications.

The low melting point material is typically implemented in one of three ways. The first, termed the "M" effect (after its discoverer, Metcalf), attaches the low melting point material to the high melting point element in such a way as to cause the high melting point material to dissolve into the lower melting point material when the latter becomes molten. Thus, after a period of time, the element is severed and an arc is initiated at the melted open point.

A second method, disclosed in U.S. Pat. No. 5,604,474 to Leach and Bennett, employs a tin low melting point material as a "bridge" between high melting point elements, wherein an arc is initiated when the tin melts. This method does not suffer from the potential deterioration problems inherent in the first method, but is harder to manufacture.

A third method known in the art employs a spring loaded joint, termed a "mouse trap," made between high melting point components using a low melting point solder. When the melting point of the solder is reached, the spring causes separation of the contacts thereby producing an arc. This method allows considerable flexibility in the design of the fuse's TCC, since the mass of the components and melting point of the solder can be used to control the melting characteristics, frequently allowing superior surge withstand for the fuse. However, in order to allow the physical movement that initiates circuit interruption, the joint has to be surrounded by a fluid (usually air) rather than by sand, which is the preferred medium to surround a fuse element because it gives improved interrupting capability to the fuse.

Whatever method is used to initiate arcing at longer melting times, a common requirement for such fuses is the provision of some form of indication that the fuse has indeed operated. This makes finding the "blown" fuse much easier.

The most common method of indication is to run a small conductive wire in parallel with the main element(s). When the main element melts, system voltage causes current to flow through the indicator wire and to melt it. The current quickly switches back to the main elements, which then arc and interrupt the overcurrent. The melting of the indicator wire provides indication through a variety of means. Most commonly, the indicator wire is arranged to release a spring loaded pin, or ignite a small explosive charge to move a striker, when the indicator wire melts. Obviously a minimum voltage, sufficient to drive enough current through the indicator wire to cause it to melt, is necessary for this indication method to work. Typically this requires at least 5-10 volts.

Another means of indication has been to connect, in parallel with the fuse, a circuit containing a light emitting device, such as a neon, LED or lamp. Again, system voltage across the indication circuit after the fuse has operated is necessary for this method to work.

For most conventional low voltage fuse applications, the techniques described above are sufficient to successfully interrupt fault currents, provide indication and then withstand system voltage for very long periods of time. However, there are some applications for which these conventional low voltage fuses are not suitable. For example, in some applications, where step-down transformers are used to supply a low voltage distribution network consisting of many parallel conductors fed from many transformers at different points in the system, it is common practice to fuse individual cables to prevent them from being overloaded. These cables typically use conventional current-limiting fuses or fusible limiters, designed to open when excessive current flows. However, it is possible in such applications for little or no voltage to appear across the limiter after the circuit is opened (only the IR drop in the parallel cables will appear across the open point), because an overloaded cable can often have other cables connected in parallel.

This leads to two potential problems. The first is that with little voltage across the limiter when melting occurs, there is little arcing. This can lead to a relatively high resistance open point, sufficient to prevent current flow in the overloaded cable, but which is not high enough to enable conventional fault finding equipment to be effective at finding the open point, as compared with a fuse which arcs and which would normally have a resistance of many millions of ohms. This delays the finding and replacing of the operated device.

Visual indication of the operated limiter would obviously be desirable to speed up the process. However, the second problem is that the lack of recovery voltage also prevents conventional indicators from working.

Accordingly, there is a need for a fuse capable of interrupting current effectively for conditions where the voltage can vary from rated voltage, down to very low values (possibly as low as 1 V) whilst providing indication of its operation in a manner that allows visual indication at the fuse, together with remote indication if desired. Such indication is needed with whatever current causes the fuse to melt open, and with what ever degree of arcing that occurs.

OBJECTS AND SUMMARY OF THE INVENTION

It is an object of the present invention to provide a fuse which is designed to provide visual indication, and a distinct open section, with relatively high currents that cause the melting of an element made from a relatively high melting point material (>500° C.), independent of the voltage that can cause arcing.

It is another object of this invention to provide a fuse which is designed to provide visual indication, and a distinct open section, with relatively low currents that cause the melting of a joint made with a relatively low melting point material (<500° C.).

It is still another object of this invention to provide a fuse with the previously described characteristics in which the open section(s) are surrounded by granular dielectric filler, the purpose of which is to improve the interrupting capability of the fuse, and to provide a better dielectric withstand after current interruption.

In the efficient attainment of these and other objects, the present invention provides a fuse with interruption indication. The fuse generally includes a fuse housing having first and second electrical terminals, a fusible structure disposed within the fuse housing and defining an electrical path between the first and second terminals, a biasing element acting on the fusible structure and an indicator rod connected to the fusible structure for providing visual indication when the fuse has blown. The fusible structure includes a movable portion and a meltable portion, wherein the meltable portion melts when subjected to a threshold current flowing therethrough. The biasing element acts on the movable portion of the fusible structure for moving the movable portion upon melting of the meltable portion. The indicator is connected to the movable portion of the fusible structure and is driven by the biasing element for providing visual indication of an interrupted condition of the fuse upon melting of the meltable portion.

In a preferred embodiment, the fusible structure includes a high fault current interrupting element responsive to high currents and a low fault current interrupting element responsive to low fault currents connected between the high fault current interrupting element and one of the first and second electrical terminals of the housing. The low fault current interrupting element preferably has a low melting point solder joint portion, while the high fault current interrupting element preferably has one or more reduced cross-section neck portions.

The fuse of the present invention further preferably includes a fixed partition disposed within and fixed to the housing and a movable partition connected between the fusible structure and the indicator rod, wherein the biasing element acts between the fixed partition and the movable partition. Also, the indicator preferably includes an indicator rod disposed within the housing, which is driven by the biasing element to protrude out of the housing upon melting of the fusible structure to provide the visual indication.

The biasing feature of the present invention can also be utilized in high current fuses with or without the indicator. Such a fuse would simply include a fuse housing having first and second electrical terminals, a high fault current interrupting element responsive to high currents disposed within the fuse housing and defining an electrical path between the first and second terminals and a biasing element. The high fault current interrupting element has a meltable portion which melts when subject to a high threshold current flowing therethrough to create a gap in the electrical path and the biasing element acts on the high fault current interrupting element for elongating the gap in the electrical path upon melting of the fusible element. Moreover, with such high current fuses, the fuse housing preferably contains a granular dielectric medium therein, and the fusible structure preferably has a sheath surrounding the movable portion of the fusible structure to prevent the granular dielectric medium from interfering with the movement of the movable portion.

As a result of the present invention, a low voltage interrupting device is provided which fulfills the above stated need and includes a housing having a conductive terminal at each end of the housing, and a fusible element electrically connected to the terminals. In one embodiment of the invention, the element is surrounded by a granular dielectric medium such as sand. The fusible element consists of one or more elements arranged to melt, at relatively high currents (that is currents typically causing melting at times less than approximately ten seconds) at one or more reduced cross-sectional points on the element, and at lower currents (typically causing melting at times longer than ten seconds) at a solder joint. It should be realized that the specified melting times for the two parts of the element are approximate and may be varied considerably, should the protection requirements so dictate.

Both the high current element and the solder joint are held in tension such that the melting action causes a physical movement of the element. This physical movement assists in the initiation of an arc, and therefore the current interruption, and provides a high resistance "gap" that is independent of the amount of arcing and therefore recovery voltage. This movement further forces movement of an indicating plunger that can provide either visual indication of the fuse's operation or can complete an external circuit to provide remote indication.

A preferred form of the fuse, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

The significance of the present invention will be best understood by a description of the sequence of events when the device is subjected to both high and low currents.

Figure 1:
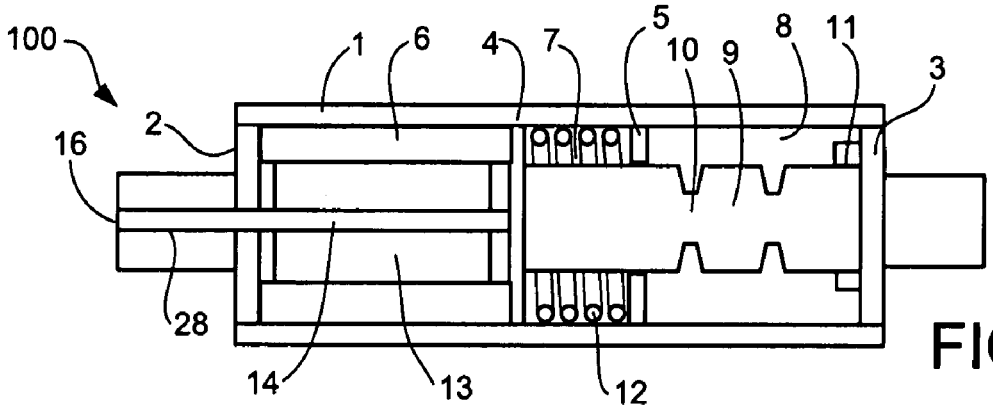
FIG. 1 is a cross-sectional view of a preferred embodiment of a low voltage fuse of the present invention.
Figure 2:
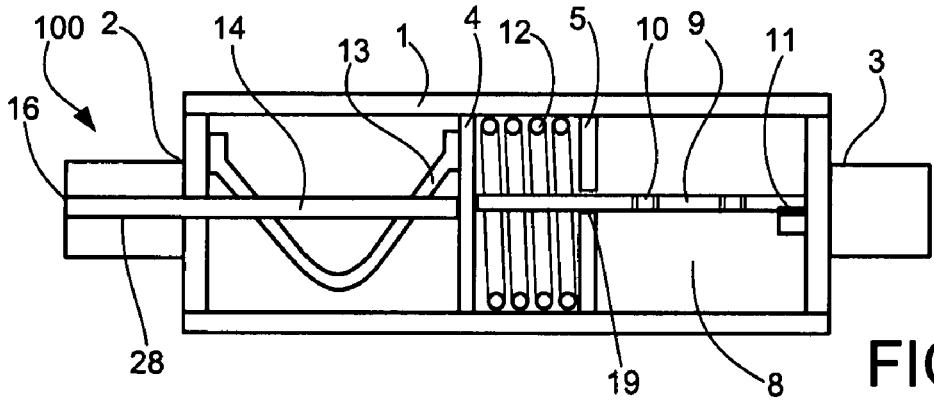
FIG. 2 is a cross-sectional view of the preferred embodiment of the low voltage fuse shown in FIG. 1 rotated 90° on its axis as compared to FIG. 1.

Referring first to FIGS. 1 and 2, the fuse 100 of the present invention generally includes an elongate, insulative, non-conducting housing 1 closed at its opposite ends with two conductive terminals 2 and 3, which are electrically connected to a power circuit. A movable partition 4 and a fixed partition 5 divide the interior of the housing 1 into three sections. First section 6 extends between movable partition 4 and the first terminal 2, second section 7 extends between the movable partition 4 and the fixed partition 5 and third section 8 extends between the fixed partition 5 and the second terminal 3.

The movable partition 4 is made of an electrically conductive material and is generally in the form of a piston-type element, which is able to slide within the interior space of the housing 1. Fixed to the movable partition 4, and passing through the second and third housing interior sections 7 and 8 is a fusible element 9 made from a high current melting material, such as copper or silver. The fusible element 9 preferably includes one or more neck portions 10 of reduced cross-sectional area, as compared with the rest of the fusible element. As can be appreciated by one skilled in the art, such reduced portions 10 are not necessary for the successful operation of a fuse made according to the present invention, but are normally preferred in order to obtain superior melting characteristics for the fusible elements.

The fixed partition 5 is fixed to the interior wall of the housing 1 and includes a slot or aperture 19, through which the fusible element 9 movably extends. The fusible element 9 extends from one end fixed to the movable partition 4, through the slot 19 of the fixed partition 5, and is attached at its opposite end to the second terminal 3. The fusible element 9 is mechanically and electrically attached to the second terminal 3 via a fusible joint 11. The fusible joint 11 is preferably a soldered joint made from a relatively low melting point material, such as tin. As will be discussed in further detail below, the fusible joint 11 is designed to release the fusible element 9 from the second terminal 3 when subjected to a low current threshold.

A biasing element 12, such as a spring, is disposed within the second housing interior section 7 between the movable partition 4 and the fixed partition 5. The biasing element 12 acts between the movable partition 4 and the fixed partition 5 to bias the partitions apart. Such biasing action keeps the fusible element 9 and the fusible joint 11 in tension. The electrical circuit is completed by a flexible conductor 13 electrically connected to the movable partition 4 at one end and electrically connected to the first terminal 2 at its opposite end.

Figure 3:
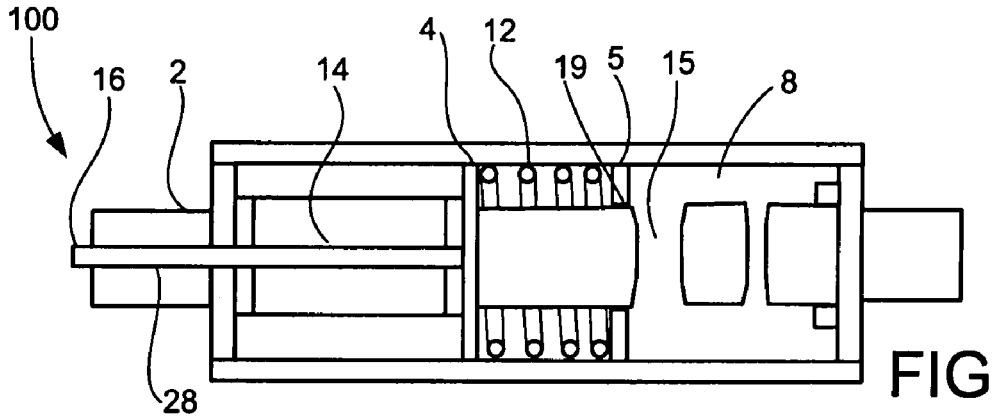
FIG. 3 is a cross-sectional view of the low voltage fuse shown in FIG. 1, after a relatively high current has melted its element.
Figure 4:
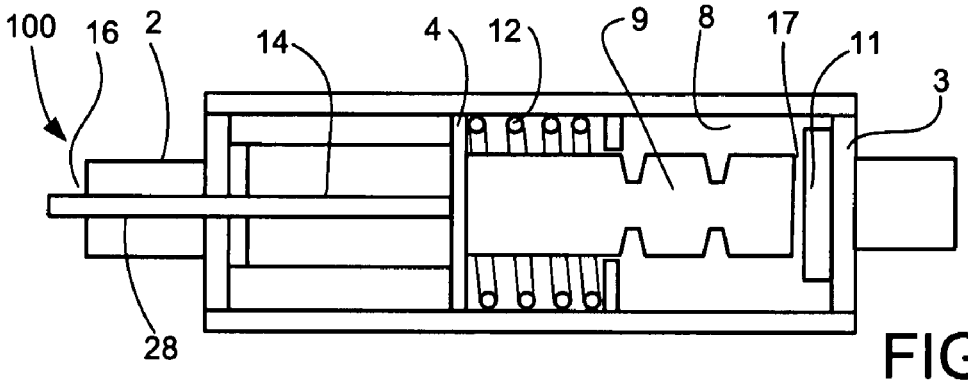
FIG. 4 is a cross-sectional view of the low voltage fuse shown in FIG. 1, after a relatively low current has melted its element.

Also attached to the movable partition 4 is an indicating rod 14, which extends from the movable partition through the first housing interior section 6 and passes through an opening 28 formed in the first terminal 2. As will be discussed in further detail below, the indicating rod 14 preferably has a length such that the protrusion end 16 of the rod, opposite the movable partition, is flush or slightly recessed within the first terminal 2 when the fuse 100 is in its operating condition, as shown in FIGS. 1 and 2, but will extend or protrude from the first terminal when the fuse is in its interrupted state, as shown in FIGS. 3 and 4. The change in the protrusion of the indicating rod 14 therefore gives indication of the condition of the fuse 100.

Specifically, as shown in FIGS. 1 and 2, with its fusible element 9 intact and connected to the second terminal 3, the fuse 100 is in its operating condition, wherein an electrical path is established between the first terminal 2 and the second terminal 3 via the flexible conductor 13, the movable partition 4, the fusible element 9 and the fusible joint 11. By virtue of the length of the fusible element 9, the housing 1 and the indicating rod 14, the protrusion end 16 of the indicating rod is disposed flush or slightly recessed within the first terminal when the fuse 100 is in its operating condition.

However, when the fuse 100 is subjected to either a high or low threshold current, the protrusion end 16 of the indicating rod 14 will protrude out from the end of the first terminal 2, thereby indicating an interrupted condition of the fuse. In particular, when the fuse 100 is subjected to a high threshold current, the fusible element 9 will melt. As mentioned above, such melting will probably occur at one or more of the reduced cross-section neck portions 10 of the fusible element 9. As shown in FIG. 3, melting of the neck portion 10 releases the tension in the fusible element 9 whereby the biasing element forces the movable partition 4 away from the fixed partition 5. Such movement draws the fusible element through the partition 5, thereby elongating the gap 15 created by the melted neck portion 10. By increasing the gap 15 in the fusible element 9, the degree of electrical arcing is significantly reduced.

At the same time, movement of the movable partition 4 away from the fixed partition 5 causes the indicator rod 14 to slide through the first terminal 2 whereby the protrusion end 16 extends out from the first terminal giving a visual indication that the fuse 100 has melted. It may be observed that this indication is independent of the degree of arcing (if any) taking place at the gap 15. Thus, if the fuse is part of a circuit wherein no significant arcing can be sustained (due to a parallel conductive path via other cables) the spring loaded action ensures that an adequate gap exists to prevent any gap breakdown (re-strike) should system voltage later be imposed on the fuse. The gap also enables conventional fault finding equipment to operate, since the fuse will have a very high resistance.

On the other hand, when the fuse 100 is subjected to a relatively low threshold current, the fusible solder joint 11 will melt, as opposed to the fusible element 9. As shown in FIG. 4, melting of the fusible joint 11 releases the fusible element from the second terminal 2. With the release of the joint tension, the biasing element 12 again forces the movable partition 4 to move away from the fixed partition 5, thereby drawing the fusible element 9 through the slot 19 in the fixed partition, which in turn elongates a gap 17 created where the solder joint 11 has melted. Simultaneously, the indicator rod 14 is driven through the opening 28 of the first terminal 2, such that the protrusion end 16 extends therefrom giving indication that the fuse has melted. Thus, under a low current condition, the fuse 100 of the present invention again reduces the degree of arcing, while at the same time provides indication of interruption.

Figure 5:
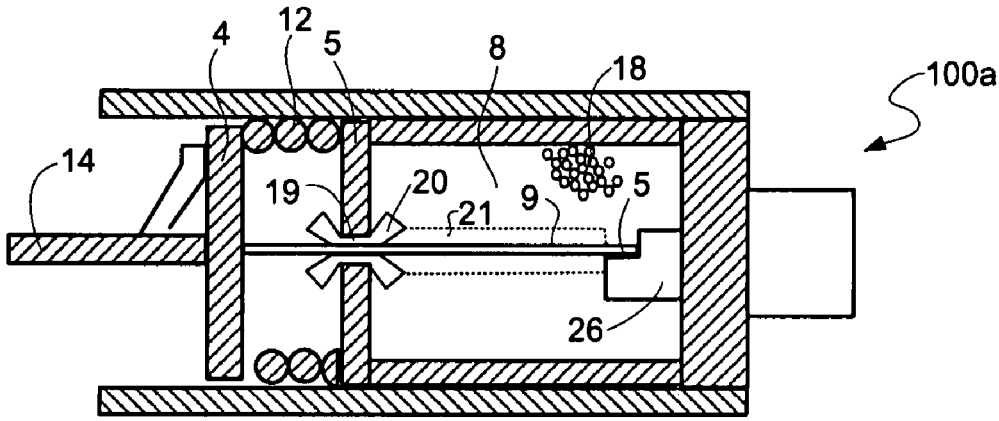
FIG. 5 is a partial cross-sectional view of an alternative embodiment of the low voltage fuse in accordance with the present invention.

The first, second and third interior chambers 6, 7, and 8 of the housing 1 can be filled with air, but the use of air surrounding a fuse element may reduce the fuse's ability to interrupt current, particularly high currents and those in circuits where conditions are severe (e.g. high X/R circuits). Accordingly, FIG. 5 shows a preferred embodiment of a fuse 100*a*, according to the present invention, wherein the third interior chamber 8, surrounding the fusible element 9, is filled with a granular dielectric medium 18, such as sand.

However, with a granular dielectric medium 18, such as sand, occupying the third chamber 8, it may be necessary to take additional steps to ensure movement of the fusible element 9 through the sand. Accordingly, to prevent the sand 18 from entering the slot 19 formed in the fixed partition 5 and thereby possibly inhibiting movement of the fusible element 9 therethrough, the slot 19 is preferably lined with a sleeve 20. The sleeve 20 is preferably made from a resilient material able to withstand high temperatures. Suitable materials include gasket materials made from ceramic or glass fiber.

The sleeve 20 is designed to prevent the sand 18 from getting wedged in the slot 19 of the fixed partition. In this regard, the sleeve 20 has a central bore having an inner diameter sized to slidably receive the fusible element 9 therein. The outer diameter of the sleeve is sized to be fitted and held within the slot 19 formed in the fixed partition 5. Also, the sleeve 20 preferably includes opposite outwardly flared ends to further facilitate slidable movement of the fusible element 9 in the sleeve.

The sleeve 20 is fixed in the fixed partition 5 and may have a length sufficient to merely line the slot 19 of the partition. Alternatively, the sleeve 20 may extend along the length of the fusible element 9 all the way to the second terminal 3. In yet another alternative embodiment, a second fusible element sleeve 21 can also be provided in addition to the slot sleeve 20 to form a sheath around all or part of the fusible element 9 to assist in its free movement, once melting is initiated.

In still another alternative embodiment of the invention, the fusible element 9 can be pre-coated or enclosed in a sheath of material having a relatively low coefficient of friction, e.g. PTFE (commonly called "Teflon"), in order to ease the movement of the element, while providing containment. If the appropriate material is used, this material assists in current interruption. Such a sheath can be used in conjunction with, or instead of granular filter material.

Figure 6:
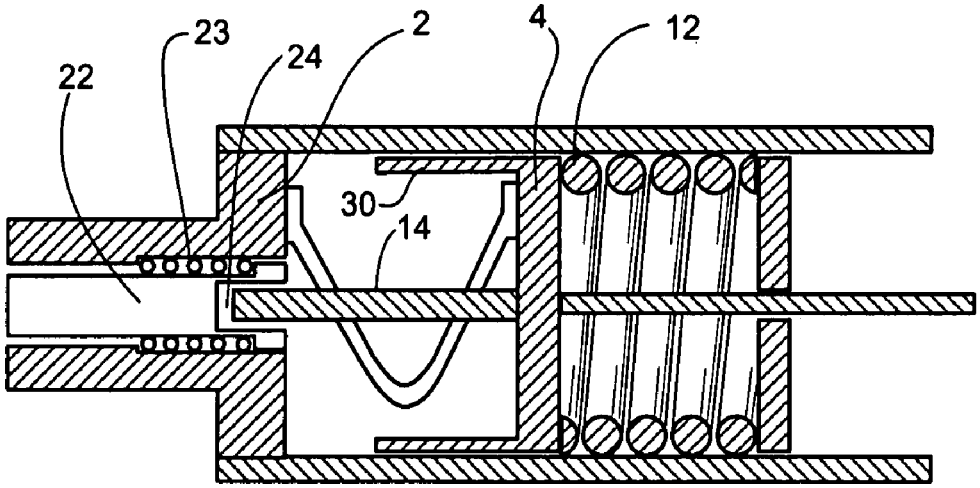
FIG. 6 is a partial cross-sectional view of another alternative embodiment of the low voltage fuse in accordance with the present invention, before the fuse has operated.
Figure 7:
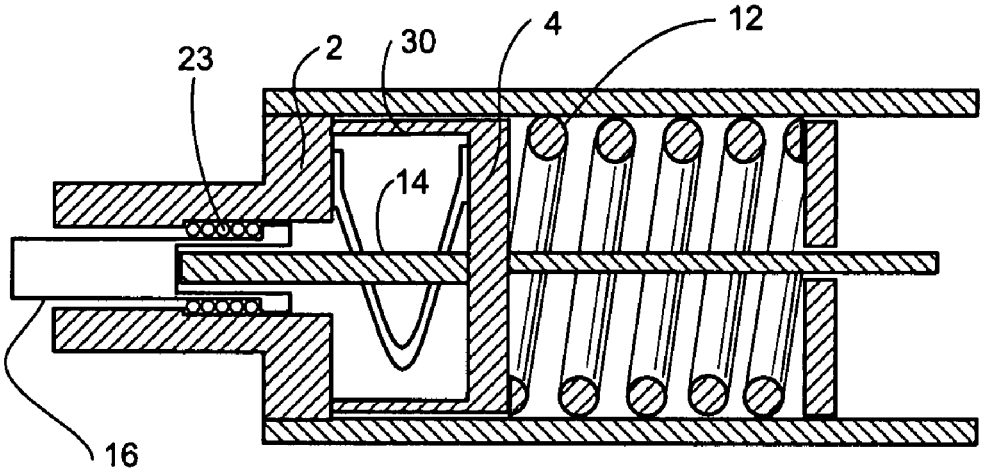
FIG. 7 is a partial cross-sectional view of the fuse shown in FIG. 6, after the fuse has operated.

Turning now to FIGS. 6-9, as described above, the movable partition 4 moves when the fuse operates (melts) so that the indicator rod 14 can be used to provide indication that the fuse has operated. The indicating rod 14 can be used to provide direct indication by protruding through the terminal, as described above. However, in a preferred embodiment, as shown in FIGS. 6 and 7, the indicator rod 14 acts upon a separate indicator button 22. In particular, an indicator button 22 is retained in a through hole of the first terminal 2, in a non-deployed state, by a second biasing element 23, such as a spring. A space 24 is left between the indicator rod 14 and the button 22 such that the button 22 does not move simultaneously with rod 14. This allows for the protrusion of the button 22 not to be affected by manufacturing tolerances that affect the position of the end of the rod 14 relative to the movable partition 4, and prevents normal thermal expansion and contraction of the fuse element from being communicated to the indicator button 22. By this means, if the indicator button 22 is used to operate a mechanism to signal fuse operation, or trip a protective device, it can be made to do so with very little movement.

Figure 8:
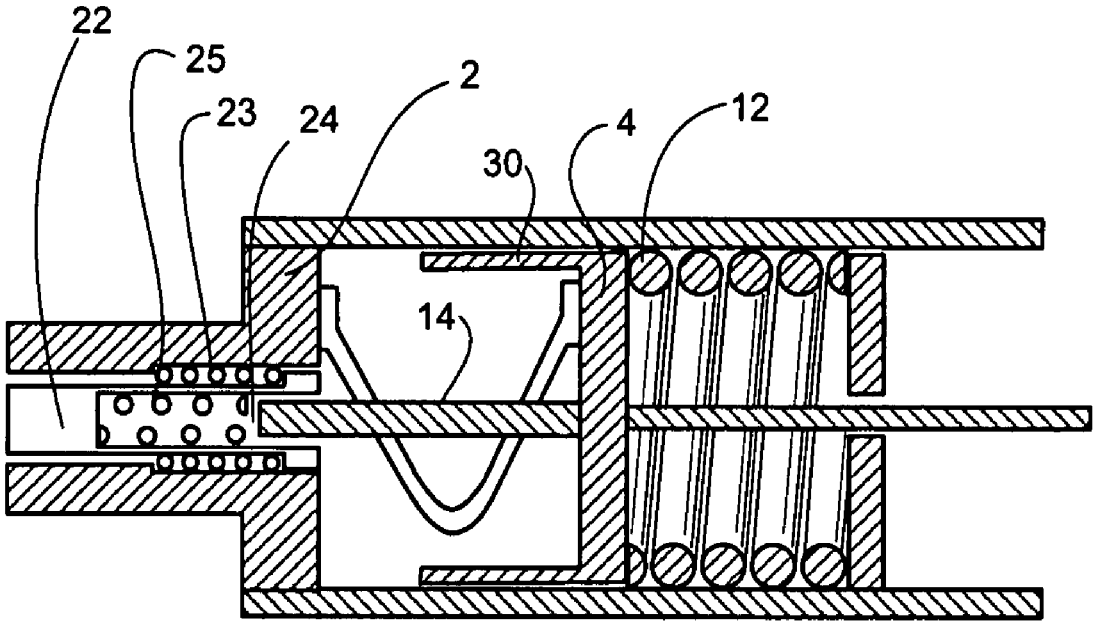
FIG. 8 is a partial cross-sectional view of still another alternative embodiment of the low voltage fuse in accordance with the present invention, before the fuse has operated.
Figure 9:
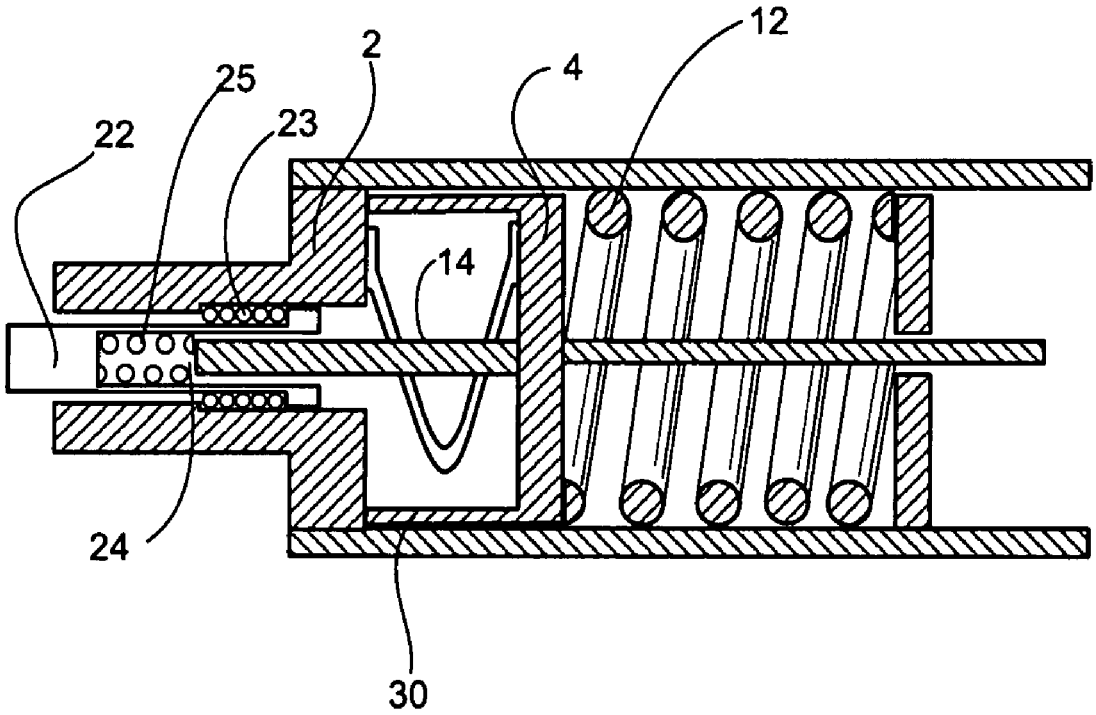
FIG. 9 is a partial cross-sectional view of the fuse shown in FIG. 8, after the fuse has operated.

In another alternative embodiment, as shown in FIGS. 8 and 9, a third biasing element 25 is utilized. Such embodiment is beneficial if it is desired that the direct force of the main spring 12 not be communicated directly to the indicator button 22. Thus, the additional resilient member 25, such as a spring, can be interposed between the indicator rod 14 and the indicator button 22.

FIGS. 6-9 also show a stop 30 provided on the movable partition 4 to limit movement of the movable partition. In particular, the stop 30 may take the form of a leg formed on the movable partition and extending in a direction toward the first end terminal 2. Upon movement of the movable partition 4, the end of the stop 30 contacts the first end terminal 2 thereby stopping further movement of the movable partition and hence the indicator 14. The length of the stop 30 can thus be chosen to impart a desired protrusion distance for the indicator 14.

A proposed application for the fuse of the present invention is to protect cables from damage caused by overheating with long duration overloads. In a fuse having a relatively short body (typically less than about 6 inches) much of the heat generated within the fuse is lost from the conductors connected to its terminals. Therefore the temperature of these conductors will significantly affect the temperature of the fuse components adjacent to them. Thus, in the preferred embodiment of the present invention, the low melting point joint 11 is located close to the second end terminal 3 of the fuse, and the conductor to be protected is connected to this terminal 3. The conductor's temperature thus has a significant influence on the temperature of the joint 11. It is therefore possible to arrange that the joint 11 well models the desired protective requirements of the cable, and arrange that this joint will melt before cable temperatures reach critical levels. In this regard, FIG. 5 shows the fusible element 9 attached by the joint 11 to an appropriately shaped heat-sink member 26, sized such that the combination of components, in conjunction with the attached cable, provide the required protection for the cable.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A fuse comprising:

a fuse housing having first and second electrical terminals;

a movable partition movably disposed within said fuse housing;

a fusible structure connected between said first electrical terminal and said movable partition, said fusible structure melting when subjected to a threshold current flowing therethrough;

a conductor connected between said movable partition and said second electrical terminal, said conductor, said movable partition and said fusible structure defining an electrical path between said first and second electrical terminals;

a biasing element contained within said housing and connected to said movable partition, said biasing element acting on said movable partition to maintain said fusible structure in tension and for moving said movable partition upon melting of said fusible structure;

an indicator connected between said movable partition and said second electrical terminal, said indicator protruding out of said second electrical terminal of said fuse housing upon melting of said fusible structure for providing visual indication of an interrupted condition of the fuse; and a fixed partition fixed within said fuse housing, said fixed partition and said movable partition defining three interior housing sections and said biasing element being retained between said fixed partition and said movable partition, wherein said fixed partition includes an aperture and said fusible structure is slidably received in said aperture, and wherein said fixed partition further includes a sleeve fixed in said aperture, said sleeve including a central bore for slidably receiving said fusible structure.

2. A fuse as defined in claim 1, wherein said fusible structure comprises:

a high fault current interrupting element connected to said movable partition, said high current interrupting element being responsive to high currents; and a low fault current interrupting element connected between said high fault current interrupting element and said first electrical terminal of said fuse housing, said low fault current interrupting element being responsive to low fault currents.

3. A fuse as defined in claim 2, wherein said low fault current interrupting element comprises a low melting point solder joint portion.

4. A fuse as defined in claim 2, wherein said high fault current interrupting element comprises one or more reduced cross-section neck portions.

5. A fuse as defined in claim 1, wherein said fixed partition is fixed between said movable partition and said first electrical terminal, and wherein an interior housing section defined between said fixed partition and said first electrical terminal is filled with a granular dielectric medium.

6. A fuse as defined in claim 1, wherein said indicator comprises:

an indicator rod fixed to said movable partition and extending toward said second electrical terminal; and an indicator button slidably received within an aperture of said second electrical terminal, said indicator rod acting on said indicator button upon melting of said fusible structure to cause said button to protrude out of said second electrical terminal.

7. A fuse as defined in claim 6, further comprising a second biasing element acting between said indicator button and said second electrical terminal for retaining said button within said second electrical terminal.

8. A fuse as defined in claim 6, wherein said indicator button is spaced from said indicator rod.

9. A fuse as defined in claim 8, further comprising:

a second biasing element acting between said indicator button and said second electrical terminal for retaining said button within said second electrical terminal; and a third biasing element acting between said indicator button and said indicator rod.

10. A fuse comprising:

a fuse housing having first and second electrical terminals and having a granular dielectric medium contained therein;

a movable partition movably disposed within said fuse housing and electrically connected to said first electrical terminal;

a fusible structure disposed within said fuse housing and connected between said movable partition and said second electrical terminal, said fusible structure and said movable partition defining an electrical path between said first and second terminals, said fusible structure having a movable portion and a meltable portion, said meltable portion melting when subjected to a threshold current flowing therethrough;

a fixed partition fixed within said housing, said fixed partition and said movable partition defining three interior housing sections, said granular dielectric medium being contained in a housing section between said fixed partition and said second electrical terminal;

a biasing element retained in a housing section between said movable partition and said fixed partition, said biasing element acting on said movable partition for moving said movable partition together with said movable portion of said fusible structure upon melting of said meltable portion of said fusible structure; and a sheath surrounding a portion of said movable portion of said fusible structure, said sheath preventing said granular dielectric medium from interfering with said movement of said movable portion, wherein said fixed partition includes an aperture, and wherein said sheath is fixed on a portion of said movable portion of said fusible structure and is slidably received in said aperture.

11. A fuse comprising:

a fuse housing having first and second electrical terminals and having a granular dielectric medium contained therein;

a movable partition movably disposed within said fuse housing and electrically connected to said first electrical terminal;

a fusible structure disposed within said fuse housing and connected between said movable partition and said second electrical terminal, said fusible structure and said movable partition defining an electrical path between said first and second terminals, said fusible structure having a movable portion and a meltable portion, said meltable portion melting when subjected to a threshold current flowing therethrough;

a fixed partition fixed within said housing, said fixed partition and said movable partition defining three interior housing sections, said granular dielectric medium being contained in a housing section between said fixed partition and said second electrical terminal; and a biasing element retained in a housing section between said movable partition and said fixed partition, said biasing element acting on said movable partition for moving said movable partition together with said movable portion of said fusible structure upon melting of said meltable portion of said fusible structure; and a sheath surrounding a portion of said movable portion of said fusible structure, said sheath preventing said granular dielectric medium from interfering with said movement of said movable portion, wherein said fixed partition includes an aperture, and wherein said sheath is fixed in said aperture and said movable portion of said fusible structure is slidably received in said sheath.

* * * * *